United States Patent [19]

Isozaki

[11] Patent Number: 4,744,281

[45] Date of Patent: May 17, 1988

[54] AUTOMATIC SOUND PLAYER SYSTEM HAVING ACOUSTIC AND ELECTRONIC SOUND SOURCES

[75] Inventor: Yoshimasa Isozaki, Shizuoka, Japan

[73] Assignee: Yamaha Corporation, Shizuoka, Japan

[21] Appl. No.: 29,804

[22] Filed: Mar. 25, 1987

[30] Foreign Application Priority Data

Mar. 29, 1986 [JP] Japan ..... 61-71869
Mar. 29, 1986 [JP] Japan ..... 61-71868

[51] Int. Cl.[4] ..... G10H 3/03

[52] U.S. Cl. ..... 84/1.28; 84/171; 84/DIG. 4

[58] Field of Search ..... 84/1.03, 1.24, 1.28, 84/DIG. 4, DIG. 12, 171

[56] References Cited

U.S. PATENT DOCUMENTS

| | | | |
|---|---|---|---|
| 2,761,344 | 9/1956 | Koehl | 84/171 |
| 2,784,633 | 3/1957 | Hess | 84/171 |
| 3,375,320 | 3/1968 | Carras | 84/171 |
| 4,104,950 | 8/1978 | Finley | 84/1.28 |
| 4,132,141 | 1/1979 | Campbell et al. | 84/1.28 |
| 4,351,221 | 9/1982 | Starnes et al. | 84/1.24 |
| 4,704,931 | 11/1987 | Nagai et al. | 84/171 |

*Primary Examiner*—Patrick R. Salce
*Assistant Examiner*—Jeffrey Starratt
*Attorney, Agent, or Firm*—Burns, Doane, Swecker & Mathis

[57] ABSTRACT

An automatic music player system having an ensemble playback mode of operation using a memory disk having recorded thereon a piece of music composed of at least two combined parts to be reproduced separately of each other, the parts being recorded in the form of at least two data subblocks, comprising a first sound generator to mechanically generate sounds when mechanically or electrically actuated, at least one second sound generator to electronically generate sounds when electronically actuated and a control unit connected to the first and second sound generators, wherein (1) one of the two or more data subblocks of the data read from the disk is discriminated from another, whereupon the discriminated one of the data subblocks is transmitted to the first sound generator and another data subblock transmitted to the second sound generator, and wherein (2) the transmission of data to the second sound generator is continuously delayed by a predetermined period of time from the transmission of data to first sound generator so that the two sound generators are enabled to produce sounds concurrently and in concert with each other.

7 Claims, 8 Drawing Sheets

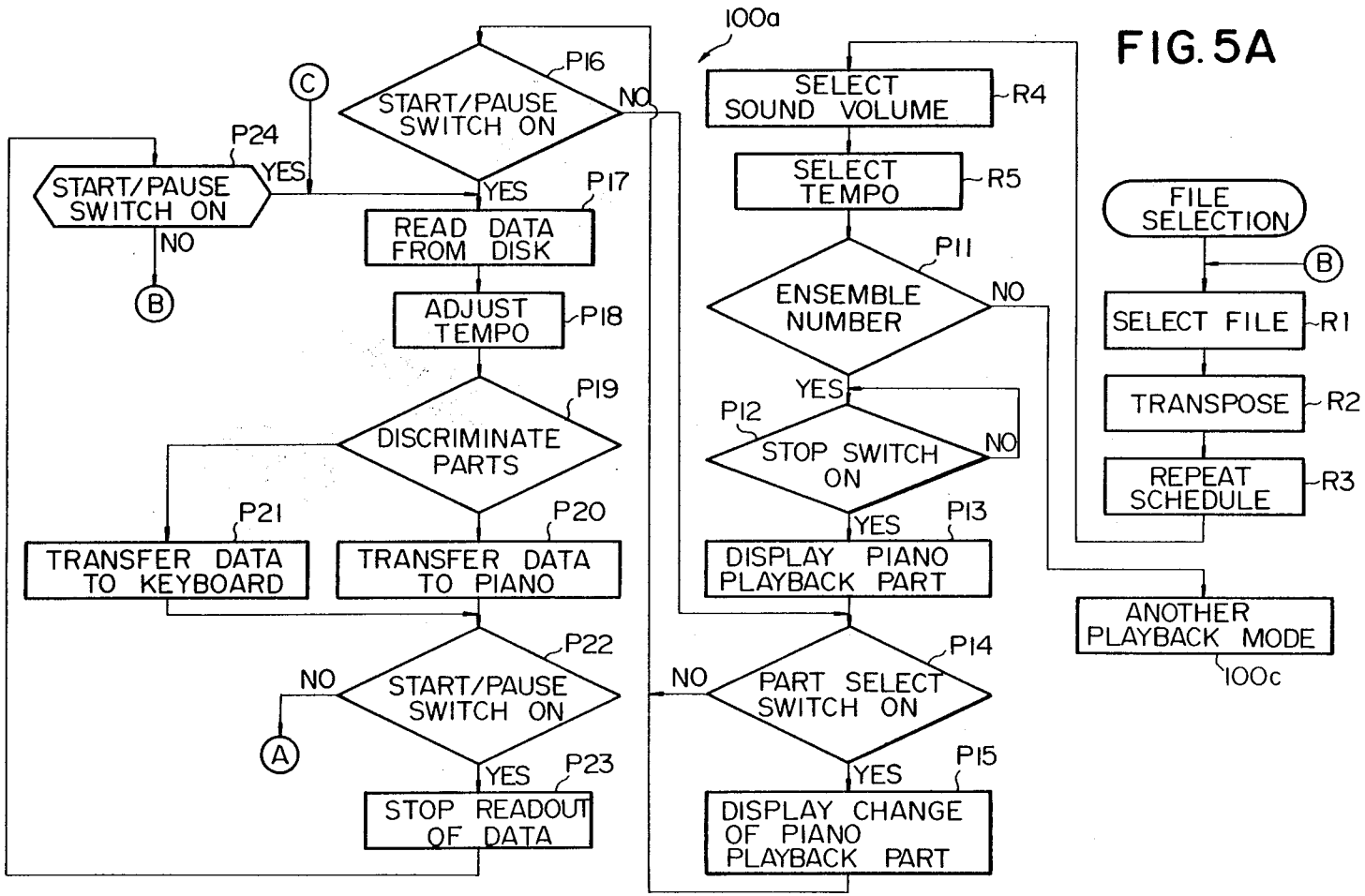
FIG. 5A
FILE SELECTION
B
SELECT FILE
R1
TRANSPOSE
R2
REPEAT SCHEDULE
R3
ANOTHER PLAYBACK MODE
100c
100a
SELECT SOUND VOLUME
R4
SELECT TEMPO
R5
ENSEMBLE NUMBER
P11
NO
YES
STOP SWITCH ON
P12
NO
YES
DISPLAY PIANO PLAYBACK PART
P13
PART SELECT SWITCH ON
P14
NO
YES
DISPLAY CHANGE OF PIANO PLAYBACK PART
P15
START/PAUSE SWITCH ON
P16
NO
YES
READ DATA FROM DISK
P17
ADJUST TEMPO
P18
DISCRIMINATE PARTS
P19
TRANSFER DATA TO PIANO
P20
TRANSFER DATA TO KEYBOARD
P21
START/PAUSE SWITCH ON
P22
NO
YES
A
STOP READOUT OF DATA
P23
C
START/PAUSE SWITCH ON
P24
YES
NO
B

AUTOMATIC SOUND PLAYER SYSTEM HAVING ACOUSTIC AND ELECTRONIC SOUND SOURCES

FIELD OF THE INVENTION

The present invention relates to an automatic music player system using the combination of mechanical and electronic sound generators.

BACKGROUND OF THE INVENTION

An automatic music player system is known which includes a player piano capable of reproducing the musical information which has originated in the piano. Such musical information is produced by an operator keying in on the keyboard of the piano and is converted into coded musical data, which are then memorized into a memory during recording mode of operation of the system. For the reproduction of the musical information thus memorized into the memory, the coded musical data are read out and are converted into corresponding driver signals, which are then applied to the individual elements of solenoid-operated drive assemblies provided within the player piano. The drive assemblies thus actuated drive the key action and control pedal mechanisms of the piano and enable the piano to generate musical sounds conforming to the data received from the memory.

One of the inconveniences experienced with an automatic music player system of this type results from the fact that any musical information which has not originated in the player piano per se could not be reproduced from the piano. Only the musical information which has been keyed in within the player system can thus be reproduced by the piano per se and, for this reason, difficulties are encountered if it is desired to perform an "ensemble" mode of playback operation between the piano of the system and any external sound generator which may be used in combination with the piano. The operator who desires to have the system perform such an ensemble mode of playback operation must set the external sound generator into operable condition appropriately by having recourse to time-consuming steps required to establish compatibility of playback performance between the piano and the sound generator.

It is, accordingly, an important object of the present invention to overcome such an inconvenience inherent in a prior-art automatic music player system through provision of an improved automatic music player system which is capable of producing both mechanically and electronically generated musical sounds concurrently one by means of a mechanical sound generator and the other by means of a suitable electronic sound generator. Such an automatic music player system typically uses a player piano as the mechanical sound generator and an MIDI (Musical Instrument Digital Interface) standardized keyboard console as the electronic sound generator. The musical information produced by an operator keying in on the keyboard of the piano is converted into coded musical data, which are then memorized into the memory provided in association with both the player piano and the keyboard console during recording mode of operation of the system. During ensemble mode of playback operation, the coded musical data stored in the memory are read out therefrom and are converted into driver signals, which are selectively applied to the individual elements of solenoid-operated drive assemblies provided within the player piano. The drive asemblies thus actuated electrically act on the key action and control pedal mechanism of the piano and enable the piano to generate "mechanical" musical sounds conforming to the data received from the memory, as in the prior-art player system. In an automatic music player system according to the present invention, the data read out from the memory are supplied not only to the solenoid-operated drive assemblies in the player piano but also to the keyboard console and electronically actuate the keyboard console to generate "electronic" musical sounds.

Such an improved automatic music player system proposed by the present invention may involve considerable amounts of delay in generating mechanical sounds by the motions of the key action and control pedal mechanisms which are driven by the solenoid-operated drive assemblies. Due to such delays on the part of the player piano, the piano could not follow the performance of the keyboard console which is electronically actuated to generate sounds electronically. The piano serving as the mechanical sound generator and the keyboard console serving as the electronic sound generator are thus unable to play back the respectively assigned parts of the music in concert with each other.

The present invention contemplates resolution of such a problem and, accordingly, it is another important object of the present invention to provide an improved automatic music player system capable of establishing complete compatibility of playback performance between the mechanical and electronic sound generator units provided in the system.

It is still another important object of the present invention to provide an improved automatic music player system in which the mechanical sound generator unit such as typically a piano is enabled to produces sounds concurrently with the electronic sound generator unit such as typically an MIDI keyboard console.

SUMMARY OF THE INVENTION

Thus, the present invention proposes to provide an automatic music player system which is cabale of performing an ensemble mode of playback operation between a mechanical sound generator such as typically a player piano and a suitable electronic sound generator provided in combination with the player piano or another form of mechanical sound generator.

The present invention further proposes to retard the transmission of data signals to the electronic sound generator so as to compensate for the retarded generation of sounds by the mechanical sound generator or piano.

In accordance with one important aspect of the present invention, there is provided an automatic music player system having an ensemble playback mode of operation using a memory medium having recorded thereon a piece of music composed of at least two combined parts to be reproduced separately of each other, the parts being recorded in the form of at least two data subblocks, comprising (a) first sound generator means to mechanically generate sounds when mechanically or electrically actuated, (b) at least one second sound generator means to electronically generate sounds when electronically actuated and (c) control means operatively connected to the first and second sound generator means, wherein said control means is operative so that (1) one of the two of more data subblocks of the data read from the memory medium is discriminated from another, whereupon the discriminated one of the data subblocks is transmitted to the first sound generator means and another data subblock is transmitted to the second sound generator means, and (2) the transmission of data to the second sound generator means is continuously delayed by a predetermined period of time from the transmission of data to the first sound generator so that the first and second sound generator means are enabled to produce sounds concurrently and in concert with each other.

In accordance with another important aspect of the present invention, there is provided an automatic music player system having a plurality of modes of operation including an ensemble playback mode of operation using a data storage medium having recorded thereon performance data representative of a piece of music composed of at least two combined parts to be reproduced separately of each other, the data being recorded on the memory medium in the form of at least two data subblocks consisting of a subblock of data representative of one of the parts of the piece of music and a subblock of data representative of the other of the parts, comprising (a) first sound generator means operative to mechanically generate sounds when actuated;

(b) at least one second sound generator means operative to electronically generate sounds when actuated; and (c) control means operatively connected to the first sound generator means and the second sound generator means, the control means comprising (c-1) data reading means operative to read data from the data storage medium, (c-2) discriminating means for discriminating one of the at least two data subblocks from another, (c-3) bidirectional first data transmission means providing data communication between the first sound generator means and the control means for transmitting the discriminated one of the data subblocks to the first sound generator means, the first sound generator means being to be actuated in response to the data transmitted through the first data transmission means, and (c-4) at least one bidirectional second data transmission means providing data communication between the second sound generator means and the control means for transmitting another data subblock to the second sound generator means, the second sound generator means being to be actuated in response to the data transmitted through the second data transmission means.

In accordance with still another important aspect of the present invention, an automatic music player system thus basically constructed and arranged further comprises (c-5) delay means for delaying the transmission of data through the second data transmission means by a predetermined period of time from the transmission of data through the first data transmission means.

The above mentioned delay means is preferably so conditioned as to continuously delay the transmission of data through the second data transmission means by a period of time of the order of 500 msec from the transmission of data through the first data transmission means.

In one preferred embodiment of an automatic music player system according to the present invention, the first sound generator means forms part of a piano and comprises (a-1) a keyboard, (a-2) a key action mechanism operatively connected to the keyboard, (a-3) a control pedal mechanism, (a-4) string arrangement associated with the key action and control pedal mechanisms, (a-5) electromagnetically operated drive assemblies associated with the key action mechanism and the control pedal mechanism, respectively, and (a-6) interface control means operatively intervening between the control means and the drive assemblies through the first data transmission means, the interface control means being operative to electrically actuate the drive assemblies in response to signals representative of the digital data received from the control means through the first data transmission means during playback mode of operation. In this instance, the plurality of modes of operation of the player system may further include a recording mode of operation, wherein the first sound generator means further comprises sensor assemblies respectively associated with the key action mechanism and the control pedal mechanism, the sensor assemblies being operative to produce musical data signals representative of the musical information keyed in on the keyboard during recording mode of operation of the player system.

BRIEF DESCRIPTION OF THE DRAWINGS

The features and advantages of an automatic music player system according to the present invention will be more clearly appreciated from the following description taken in conjunction with the accompanying drawings, in which:

FIGS. 5A and 5B are flowcharts showing the subroutine programs including the program predominant over the ensemble mode playback operation of the automatic music player system embodying the present invention, wherein the letters A, B and C each enclosed within a circle indicate connectors through which flows of the program are to jump;

DESCRIPTION OF THE PREFERRED EMBODIMENT

Figure 1:
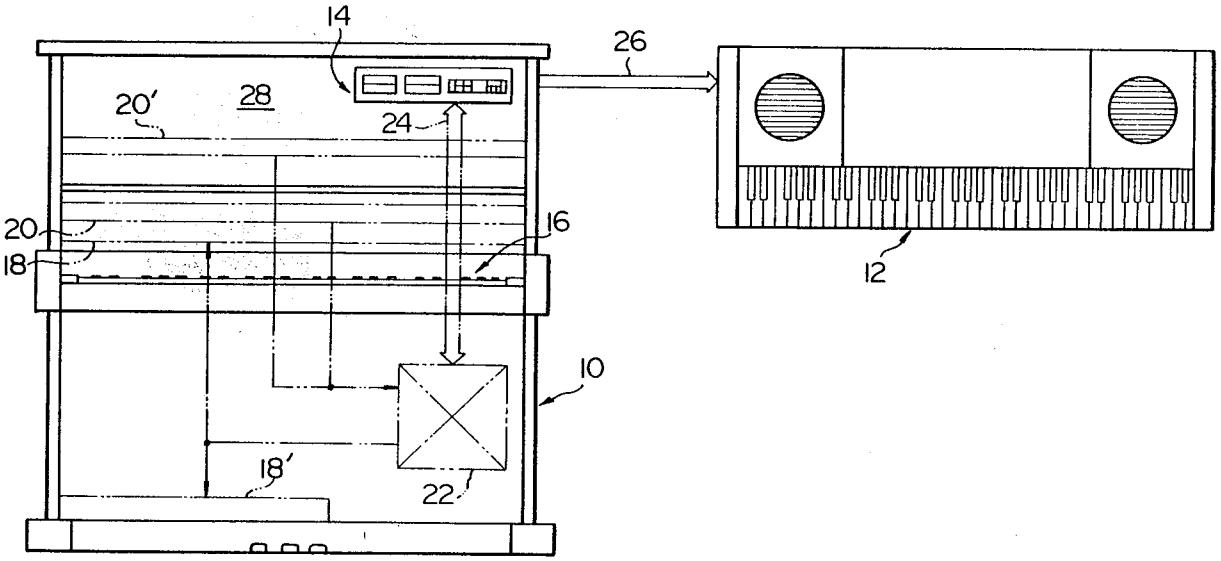
FIG. 1 is a front elevation view showing the overall configuration of a preferred embodiment of an automatic music player system according to the present invention.

Referring to FIG. 1 of the drawings, an automatic music player system embodying the present invention generally comprises a mechanical sound generator herein implemented by an automatic player piano 10, an electronic sound generator herein implemented by a keyboard console 12, and a control unit 14 which is herein assumed to be incorporated in the automatic player piano 10.

Similarly to ordinary mechanical pianos, the automatic player piano 10 includes a keyboard 16 consisting of a number of key elements operatively connected to a key action mechanism incorporated in the piano 10. The key action mechanism includes a plurality of key action units respectively associated with the individual key elements of the keyboard 16. Such a key action mechanism is further associated with the string arrangement of the piano 10, together with a control pedal mechanism which includes a plurality of control units respectively associated with the control pedals of the piano 10. These mechanical components of the piano 10 may be per se similar to those of an ordinary mechanical piano and, as such, no further description will be herein incorporated.

In the case of the automatic player piano 10 of the system embodying the present invention, there are further incorporated solenoid-operated drive assemblies 18 and 18' each including a plurality of drive elements, sensor assemblies 20 and 20' each including a plurality of sensor elements, and an input/output interface control module 22. The drive elements of one solenoid-operated drive assembly 18 are respectively associated with the individual units of the key action mechanism and are operative to selectively drive these units of the key action mechanism when electrically actuated. Likewise, the drive elements of the other solenoid-operated drive assembly 18' are respectively associated with the individual units of the control pedal mechanism and are operative to selectively drive these units of the pedal mechanism also when electrically actuated. The drive assemblies 18 and 18' are responsive to the coded musical data signals received from the control unit 14 during playback mode of operation of the player system. On the other hand, the sensor elements of one sensor assembly 20 are respectively associated with the individual key elements of the keyboard 16 and are operative to produce electrical signals when mechanically actuated. Likewise, the sensor elements of the other sensor assembly 20' are respectively associated with the individual units of the control pedal mechanism and are operative to produce electrical signals also when mechanically actuated. The sensor assemblies 20 and 20' are thus responsive to the motions of the keyboard key elements and control pedals to produce musical data signals representative of the musical information keyed in one the keyboard 16 during recording mode of operation of the player system. Such sensor assemblies may be of the electrical, photoelectrical, electromagnetic or electromechanical type. The input/output interface control module 22 provides interfaces between the player piano 10 and the control unit 14 and is electrically connected on one hand to the drive assemblies 18 and 18' and sensor assemblies 20 and 20' and on the other hand to the control unit 14 through a bidirectional bus 24. The control unit 14 in turn is connected to an MIDI input terminal (not shown) of the keyboard console 12 through a bidirectional bus 26 as shown. The interfaces provided by the input/output interface control module 22 between the piano 10 and control unit 14 include an interface required for the musical data signals to be produced by the sensor assemblies 20 and 20' of the piano 10 and transmitted from the input/output interface control module 22 to the control unit 14 during recording mode of operation. The interfaces between the piano 10 and control unit 14 further include an interface required for the coded musical data signals to be produced by the control unit 14 and supplied from the control unit 14 to the input/output interface control module 22.

Thus, in the player system embodying the present invention, the combination of the keyboard 16, key action and control pedal mechanisms, string arrangement, solenoid-operated drive assemblies, sensor assemblies and input/output interface control module 22 provides first sound generator means operative to mechanically generate sounds when mechanically or electrically actuated. On the other hand, the keyboard console 12 operatively connected to the control unit 14 together with such mechanical sound generator means provides second sound generator means which is operative to electronically generate sounds when electronically actuated. If desired, the player piano 10 which thus forms part of the embodiment of the player system herein shown may be substituted by any other form of mechanical sound generator means insofar as the sound generator includes any equivalents of the keyboard 16, solenoid-operated drive assemblies 18 and 18', sensor assemblies 20 and 20' and input/output interface control module 22.

The built-in control unit 14 has a front control panel exposed through an aperture formed in a front upper panel 28 forming part of the frame structure of the piano 10 so as to allow the operator to have easy access to the control unit 14. The control unit 14 thus incorporated in the player piano 10 has a MIDI output terminal (not shown) electrically connected via the bidirectional bus 26 to the MIDI input terminal of the keyboard console 12. While the control unit 14 is herein assumed as being incorporated in the player piano 10 per se, this is simply by way of example and it will be apparent that the control unit forming part of an automatic music player system according to the present invention may be provided separately or externally of the piano insofar as the control unit is operatively associated with the piano.

Description will be hereinafter made with further reference to FIGS. 2A and 2B in regard to the major control functions of the control unit 14 of the player system shown in FIG. 1.

Figure 2A:
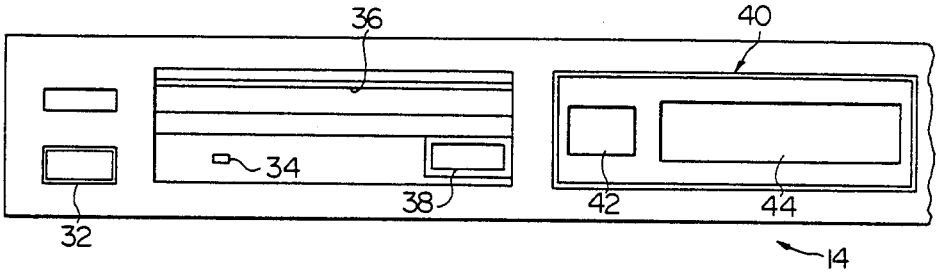
FIGS. 2A and 2B are fragmentary front elevation views jointly showing, to an enlarged scale, the front panel configuration of the control unit which forms part of the player system illustrated in FIG. 1.
Figure 2B:
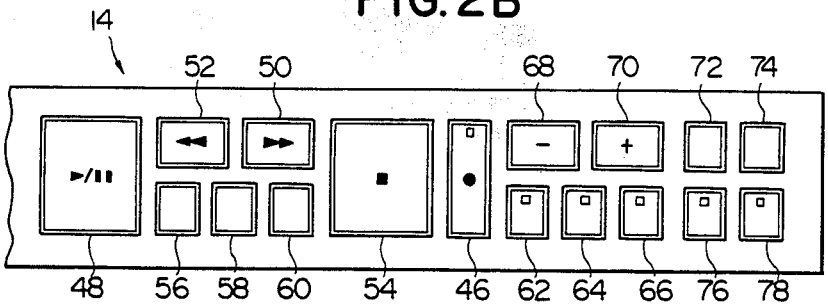

As shown in FIGS. 2A and 2B, the control unit 14 of the player system embodying the present invention comprises a manually-operated power supply switch 32 which when initially depressed by the operator makes the control unit 14 ready to operate. With the power supply switch 32 depressed and turned on, a glow lamp indicator 34 provided on the front panel of the control unit 14 is energized and glows to indicate that an on-line interface is established between the control unit 14 and each of the piano 10 and keyboard console 12 and that all the electric and electronic functional components of the system are ready to operate. The control unit 14 further comprises a disk tray 36 having an elongated slot which is open through the front panel of the control unit 14. A suitable write/read data storage medium which is typically a flexible or "floppy" memory disk (hereinafter referred to simply as memory disk) is to be loaded through this disk tray 36 into and out of disk drive module (not shown) incorporated in the control unit 14. The disk drive module of the control unit 14 implements the data readout means which forms part of an automatic music player system according to the present invention. On the memory disk may be preliminarily recorded various coded musical and control data necessary for the reproduction of a piece or pieces of music from the player system, viz., either from the player piano 10 alone or concurrently from both the player piano 10 and the keyboard console 12. A disk eject switch 38 is provided so that the memory disk once loaded into the control unit 14 can be automatically withdrawn from the disk tray 36 with the switch 38 manually depressed by the operator.

The control unit 14 further comprises a liquid-crystal display section 40 including a file name display window 42 and a prompt information display window 44 for displaying various kinds of information depending on the different operational phases of the player system. The file name display window 42 is used for the display of the registered file name assigned to the piece of music to be or being keyed in from the keyboard 16 of the piano 10 and recorded on the memory disk in place or the piece of music to be or being played back by the piano 10 per se and/or the keyboard console 12. The information to be displayed on the prompt information display window 44 typically includes the name assigned to the memory disk currently set in the control unit 14, the title and composer's name of the piece to be played back, and various instructions, reports or notices, questions and answers to be notified to the operator such as the channel number of that part of an ensemble musical number which is to be played back by the player piano 10 per se. The information to be displayed on the display window 44 may further include the selected sound level for the recording or playback operation in progress, various variable parameters such as the time which has lapsed subsequent to the start of the recording or playback operation currently in progress, and so forth.

There is further provided a record enable switch 46 which when depressed makes the player system ready to start for operation in recording mode. The record enable switch 46 is also associated with a glow lamp indicator which is to glow when the switch 46 is depressed and turned on. In association with the record ready switch 46 is further provided a record/playback start/pause switch 48 which when depressed enables the player system to start for operation in recording or playback mode or to interrupt the recording or playback mode of operation which has once been started. When the record/playback start/pause switch 48 is depressed after the record enable switch 46 has been depressed, the player system is initiated into operation in recording mode so that the sound information produced as a result of the operator's keying actions is sequentially recorded on the memory disk set in the disk drive module of the control unit 14. On the other hand, file-select/fast-forward and file-select/fast-reverse drive switches 50 and 52 are provided to control the selection of the musical number or numbers to be played back or the fast-forward or fast-reverse disk drive mode which may be selected during playback operation. When one of these switches 50 and 52 is depressed with the player system in a rest condition or ready to start for recording operation with the switch 46 turned on, the registered file names of the pieces of music recorded on the memory disk in use are displayed on the display window 52 one after another in a forward or backward order until the switch 50 or 52 is depressed once again. The operator of the system is thus enabled to visually select the registered file name of the piece of music which is desired to be played back. If, on the other hand, the switch 50 or 52 is depressed during playback operation, the memory disk in use is driven at a fast speed either forwardly or backwardly for fast-forward or fastreverse disk drive mode of operation. A stop switch 54 is to be depressed to put an end to the recording, playback, fast-forward disk drive or fast-reverse disk drive mode of operation.

There are further provided first, second and third playback repeat switches 56, 58 and 60 which are predominant over different schedules of repeated playback operation for one or more musical numbers. Any of these switches 56, 58 and 60 may be depressed with the player system in a rest condition or conditioned in a playback mode. The first playback repeat switch 56 is to be used for the selection of a program repeat schedule to play back all the musical numbers of the program on the memory disk repeatedly. The playback repeat schedule selected by this switch 56 remains effective until the particular switch 56 is depressed for a second time. The second playback repeat switch 58 is to be used for the selection of a single-number repeat schedule to playback a single selected piece of music repeatedly. The playback repeat schedule selected by this switch 58 remains effective also until the switch 58 is depressed for a second time. The third playback repeat switch 60 is to be used when it is desired that a specified limited section of a single selected piece of music be played back repeatedly. Such a playback repeat schedule is cancelled when the switch 60 is depressed once again.

The control unit 14 of the automatic music player system embodying the present invention further comprises a soundvolume control switch 62, a tempo select switch 64 and a transposition enable switch 66, each of which cooperates with associated decrementing and incrementing switches 68 and 70. The sound-volume control switch 62 is to be used to adjust the sound volume of the music to be played back by means of the player piano 10 and, when the decrementing or incrementing switch 68 or 70 is depressed after the control switch 62 has been depressed, the sound volume which has been selected as desired or established as normal is varied to decrease with the decrementing switch 68 depressed or increase with the incrementing switch 70 depressed. The tempo select switch 64 is to be used to stepwise vary the tempo of the music to be reproduced by each of the player piano 10 and the keyboard console 12 and, when the decrementing or incrementing switch 68 or 70 is depressed after the tempo select switch 64 has been depressed, the tempo which has been selected as desired or established as normal is varied at prescribed pitches to decrease with the decrementing switch 68 depressed or increase with the incrementing switch 70 depressed. It may be herein noted that the "normal" tempo of a piece of music included in the program on a memory disk is the tempo used during recording of the particular number and is displayed on the display window 44 by a default rule when the tempo select switch 64 is depressed prior to or during playback operation. With the switch 68 or 70 depressed after the switch 64 has been depressed, there are successively displayed a series of numerals indicating the selectable tempos at the pitches of, for example, plus or minus 10% from the zero per cent point which corresponds to the "normal" tempo. On the other hand, the transposition enable switch 66 is to be used to stepwise vary the key of the music or the part of the music to be played back by means of the player piano 10 per se. When either the decrementing switch 68 or the incrementing switch 70 is depressed after the switch 66 has been depressed, the key or tonality which has been selected as desired or established as normal for the music or the part of the music to be played back by the player piano 10 is varied at prescribed pitches either in a descending order with the switch 68 depressed or in an ascending order with the switch 70 depressed. It may be noted that the "normal" key of a piece of music is also determined during recording of the particular musical number and is displayed on the display window 44 by a default rule when the transposition enable switch 66 is depressed prior to or during playback operation. With the switch 68 or 70 depressed after the switch 66 has been depressed, there are successively displayed the selectable numbers by which the key of the piece to be played back by the piano 10 can be incremented or decremented from the "normal" key. Each of the swtiches 62, 64 and 66 is effective when depressed during playback operation, under playback "pause" condition or when the player system is at rest.

There are further provided a pair of ensemble part select switches 72 and 74 which may be used for the combined or united reproduction of the two or more parts of a piece of part music or, as herein referred to, an ensemble musical number. The data for an ensemble musical number are written in coded form into a memory disk by means of, for example, an MIDI sound recorder or a frequency-modulation (FM) sound synthesizer compatible with the control unit 14. An ensemble musical number thus recorded on a memory disk is registered as such within the memory disk and can be reproduced also as such from the memory disk. The separate parts of an ensemble musical number as represented by coded musical data are respectively represented by separate data subblocks which are identified by different data transmission channel numbers respectively assigned to the two subblocks or parts and registered within the memory disk. These two or more subblocks of the coded musical data are loaded one after another into the data storage area of a single, common file of the memory disk and are to be read to concurrently from the memory disk file during playback of the ensemble musical number. During playback operation with a dual-part or "duet" musical number, the two data subblocks of the coded musical data are discriminated from each other on the basis of the data transmission channel numbers assigned to the subblocks. The coded musical data contained in one of the two data subblocks thus discriminated from each other may be transferred to and reproduced from the player piano 10 per se through a selected data transmission channel. The data contained in the other data subblock may be transferred to and reproduced from the keyboard console 12 through another selected data transmission channel. The data transmission channel through which the coded musical data for the part to be played back by the keyboard console 12 is to be transmitted is selected depending on the data transmission channel number (hereinafter referred to simply as channel number) assigned to the particular subblock or part. The channel number indicating that part of an ensemble musical number which is to be ordinarily played back by means of the player piano 10 per se is displayed by a default rule on the prompt information display window 44 of the control unit 14 when the number is selected with the file-select switch 50 or 52 depressed.

The ensemble part select switches 72 and 74 are used for the selection of that part of an ensemble musical number which is to be played back by the player piano 10 per se. When one of these part select switches 72 and 74 is depressed after an ensemble musical number has been selected from among the files of the memory disk with the file-select switch 50 or 52 depressed, the registered channel numbers of the individual parts of the selected ensemble musical number are displayed one after another on the prompt information display window 44 in a forward or backward order. One part select switch 72 is used to decrement the channel number and the other part select switch 74 used to increment the channel number on display, enabling the operator to select the registered channel number of that part of the selected ensemble musical number which is to be played back by means of the player piano 10 per se. While it is herein assumed by way of example that an ensemble musical number is composed of two combined parts one of which is to be played back by the player piano 10 and the other by the keyboard console 12, an ensemble musical number with three or more combined parts may be played back by an automatic music player system according to the present invention. Where such an ensemble musical number with more than two combined parts is to be played back, one or more keyboard units or other forms of electronic musical instruments or sound generators will be required in addition to the single keyboard console 12 provided in the player system shown in FIG. 1. As well known in the art, an electronic audio system designed and engineered to comply with the MIDI standards ordinarily has a total of sixteen data transmission channels available. Thus, the player piano or any other type of mechanical sound generator forming part of an automatic music player system according to the present invention may be used in combination with a maximum of fifteen electronic musical instruments or sound generators for the reproduction of an ensemble musical number composed of a maximum of sixteen parts.

The control unit 14 of an automatic music player system embodying the present invention further comprises a metronome enable switch 76 and an MIDI interface enable switch 78. The metronome enable switch 76 is to be used to perform metronome functions with the desired tempo or the desired number of beats selected with the tempo select switch 64 and one of the associated decrementing and incrementing switches 68 and 70 depressed. On the other hand, the MIDI interface enable switch 78 is to be used to establish an interface between the control unit 14 and any MIDI musical instrument or sound generator which is herein represented by the keyboard console 12 as provided in the player system shown in FIG. 1.

Figure 3:
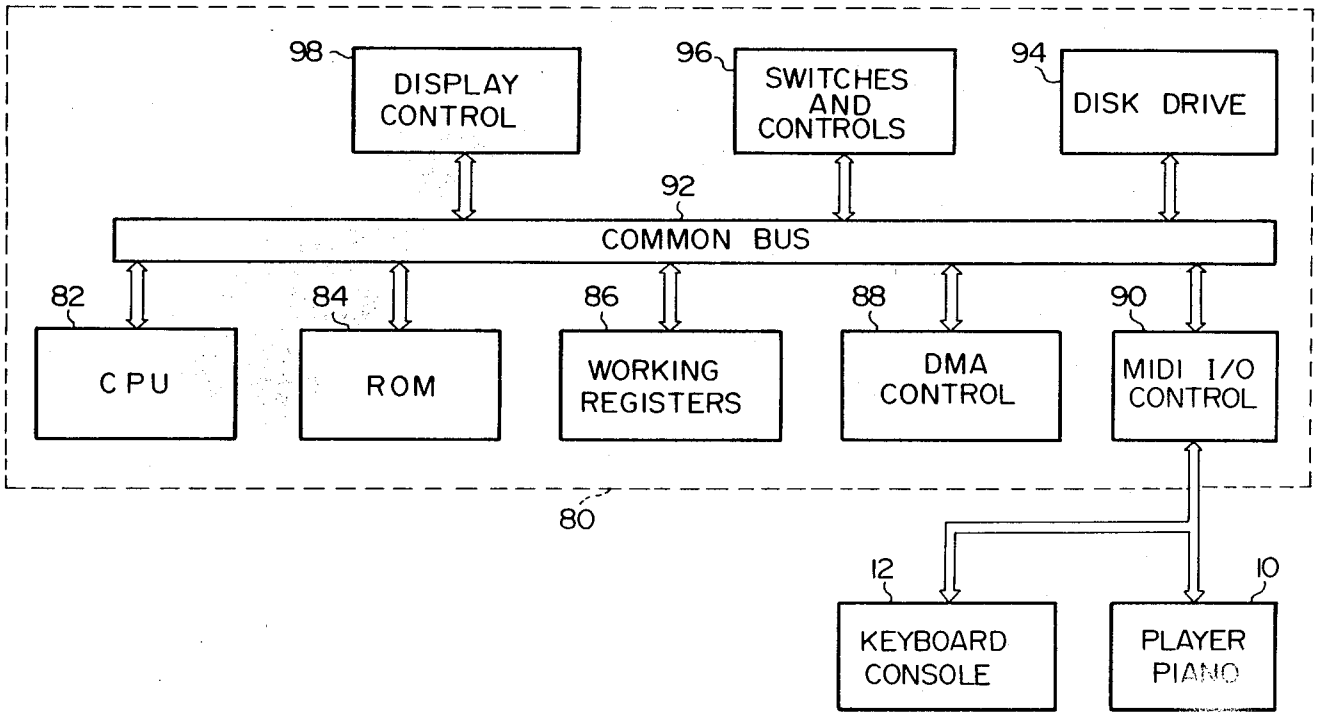
FIG. 3 is a block diagram schematically showing an example of a computer hardware structure operable for implementing the algorithms to execute the various control functions to be performed by the control unit of the player system embodying the present invention.

FIG. 3 schematically shows an example of a computer hardware structure operable for executing the algorithm of these control functions achievable by the control unit 14. As shown, the hardware structure, designated in its entirety by numeral 80, corresponds in effect to the control unit 14 and comprises a central processing unit 82 (CPU), a read-only memory 84 (ROM), a set of working registers 86, a direct memory access (DMA) controller 88 and an MIDI input/output control circuit 90, all of which are bidirectionally combined together through a common bus 92.

Figure 4:
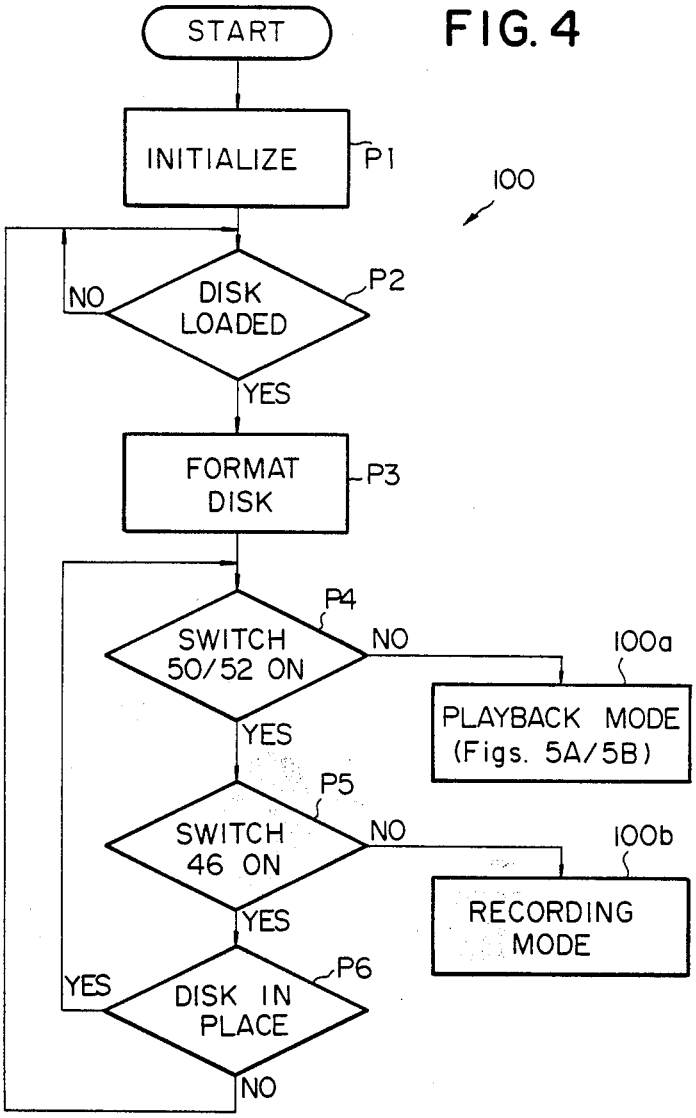
FIG. 4 is a flowchart showing the main routine program useful for executing the general algorithm to execute such control functions of the control unit.
Figure 5B:
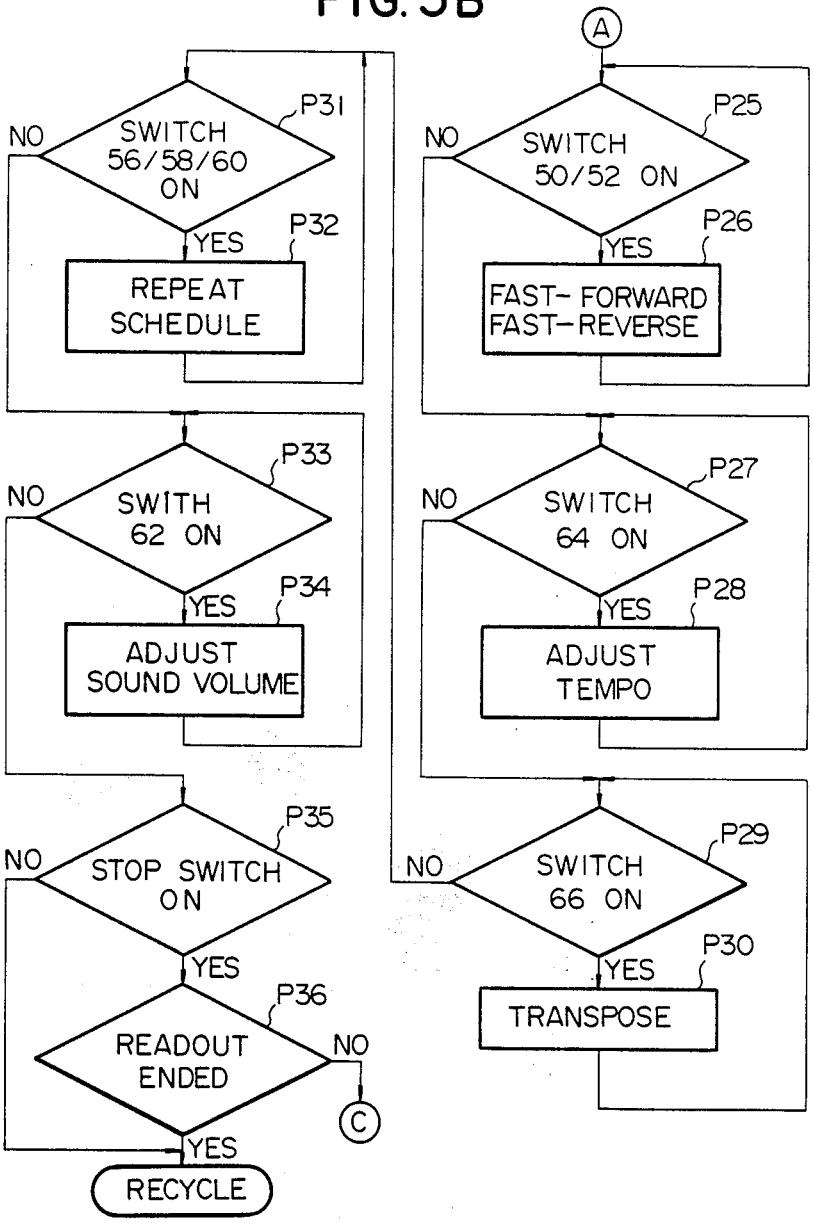

During operation of this hardware structure, the central processing unit 82 accesses the read-only memory 84 by way of the common bus 92 so as to read the programs stored in the memory 84 and successively executes the instructions thus fetched from the memory 84. The programs stored in the read-only memory 84 include an operating system program which governs the operation of the player system as a whole, a system initializing program, and a main routine program which dictates the basic mode of operation of the control unit 14 as shown in the flowchart of FIG. 4. Also stored in the memory 84 are the subroutine programs to be predominant over the playback operation in solo and ensemble modes of the player system as shown in FIGS. 5A and 5B and the delaying subroutine programs which feature the player system proposed by the present invention as will also be described later.

On the other hand, the working registers 86 are operative to memorize data codes representative of the various data codes input from the control unit 14 during or prior to various stages or modes of operation of the player system. Typical ones of these data codes include:

a data code which indicates the file name of the selected piece of music, as input from the file-select/fast-forward or file-select/fast-reverse drive switch 50 or 52 of the control unit 14, a data code which indicates the selected playback repeat schedule, as input from any of the playback repeat switches 56, 58 and 60 of the control unit 14, a data code which indicates the selected sound volume of the music to be played back by the player piano 10, as input from the decrementing or incrementing switch 68 or 70 under the control of the sound-volume control switch 62 of the control unit 14, a data code which indicates the tempo of the music to be played back, as input from the decrementing or incrementing switch 68 or 70 under the control of the tempo select switch 64 of the control unit 14, a data code which indicates the selected key of the music to be played back by the player piano 10, as input from the decrementing or incrementing switch 68 or 70 under the control of the transposition enable switch 66, and a data code indicating that part of the selected ensemble musical number which is to be played back from the player piano 10 during ensemble-mode playback operation, as input from one of the part select switches 72 and 74 of the control unit 14.

The direct memory access controller 88 is operative to establish a channel from the player piano 10 to the disk drive module 94 of the control unit 14 or from the disk drive module 94 to each of the player piano 10 and keyboard console 12 through the MIDI input/output control circuit 90. the direct memory access controller 88 is initiated into action under the control of the built-in operating system of the central processing unit 82 so as to directly access the memory disk in the disk drive module 94 during recording or playback mode of operation of the system. During recording mode of operation of the player system, the direct memory access controller 88 establishes a direct memory access channel leading from the player piano 10 to the disk drive module 94. By way of this direct memory access channel, the musical information originating in the player piano 10 is written into the data storage area of a newly entered file of the memory disk set in the disk drive module 94 without interrupting the central processing unit 82. Such musical information is produced by the sensor assemblies associated with the keyboard 16 and key action mechanism of the player piano 10 as the operator keys in on the keyboard 16 of the piano 10. During playback mode of operation of the system, on the other hand, the direct memory access controller 88 establishes a channel through which the musical data read out from the memory disk in the disk drive module 94 is to be transmitted to the piano 10 and keyboard console 12 without assistance from the central processing unit 82. The specific collection of the musical data to be fetched from the memory disk is designated by the file name memorized in one of the working registers 86 and informed from the particular register 86 to the direct memory access controller 88 by means of the central processing unit 82. The coded signals representative of the musical data read from the memory disk are passed through the MIDI input/output control circuit 90 on one hand to the input/output interface control module (not shown) provided in the player piano 10 and on the other hand to the MIDI input terminal of the keyboard console 12 (FIG. 1). The input/output interface control module incorporated in the player piano 10 decodes the coded musical data signals thus received through the MIDI input/output control circuit 90 and produces driver signals to selectively actuate the solenoid-operated drive assemblies associated with the key action and control pedal mechanisms of the player piano 10.

Each of the various switches and controls incorporated in the control unit 14 as hereinbefore described with reference to FIGS. 2A and 2B is periodically monitored or scanned by means of the central processing unit 82 also through the common bus 92 as shown in FIG. 3 in which such switches and controls are colelctively represented by block 96. When any one of these switches and controls 96 is manually acted upon, viz., initially depressed, depressed after once depressed or released by the operator and is thus turned on or off during operation of the player system, the switch action is responded to by the software incorporated in the central processing unit 82. The central processing unit 82 thus increments or decrements the program address in the instruction pointer of the unit 82 or transfers the data code or codes representative of the result of the particular switch action to any appropriate one or ones of the working registers 86. The data codes produced by the manipulative actions on the switches and controls 96 of the control unit 14 are periodically detected by the central processing unit 82 and, if determined to be necessary, are transmitted through the common bus 92 to a display controller 98 for visual display on the liquid-crystal display section 40 of the control unit 14 (FIGS. 2A and 2B).

FIG. 4 shows the flowchart of a main routine program 100 effective to execute the general algorithm of the control scheme to be implemented by means of the computer hardware structure 80 incorporated in the control unit 14 of the player system embodying the present invention. Description will now be made regarding some modes of operation of the player system with further reference to the flowchart of FIG. 4. In the description to follow, the computer hardware structure 80 as thus far described will be hereinafter referred to as computer system.

When the power supply switch 32 is depressed and turned on, the computer system 80 starts operation and first executes a system initializing program as by step P1 to set all the variable information in the computer system 80 to the starting values. The computer system 80 then checks into the disk drive module 94 in the control unit 14 to see if a memory disk has been loaded into the drive module 94 as by decision step P2. If there is no memory disk found set in the disk drive module 94. the module 94 is monitored repeatedly until it is finally detected that there is a memory disk inserted into the disk drive module 94. It being now found that there is a memory disk set in the disk drive module 94, the computer system 80 proceeds to process step P3 to perform some disk processing procedures such as the formatting of the disk in plate if it is determined that such a procedure is necessitated for the disk.

When the disk processing procedures are complete so that the memory disk in place is ready to be effectively accessed, the computer system 80 sequentially monitors or "scans" the individual switches and controls 96 on the control unit 14. It is thus questioned by step P4 whether or not the file-select/fast-forward drive switch 50 or file-select/fast-reverse drive switch 52 is turned on. If it is determined that one of these switches 50 and 52 is turned on, the computer system 80 then proceeds to a playback subroutine program **100*a* to enable the player system to perform playback operation in solo or ensemble mode. Details of the subroutine program 100*a* for the ensemble-mode playback operation in particular are depicted in FIGS. 5A and 5B** and will be described later.

If it is found in the decision step P4 that none of the switches 50 and 52 is turned on, the computer system 80 then proceeds to another decision step P5 to test whether or not the record enable switch 46 in turned on. If it is determined that the record enable switch 46 is turned on, the computer system 80 now proceeds to a recording subroutine program **100*b*. In this case, the direct memory access controller 88 accesses the disk drive module 94 and enables the central processing unit 82 to write coded musical data into the memory disk in place as the operator keys in on the keyboard 16 of the piano 10. If it is determined in the decision step P5 that the record enable switch 46 still remains turned off, the computer system 80 for a second time monitors the disk drive module 94 to see if the memory disk which has once been confirmed to be set in the drive module 94 is still in place, as by another decision step P6. If this is the case, the computer system 80 reiterates the loop consisting of the decision steps P4, P5 and P6 until it is finally found that either one of the file-select/fast-forward and file-select/fast-reverse drive switches 50 and 52 or the record enable switch 46 is turned on. If it is detected in the decision step P6 that the memory disk which had once been set into the disk drive module 94 has been removed from the drive module 94 and is absent in the module 94, the computer system 80 returns to the initial decision step P2 to check into the disk drive module 94 to see if another memory disk has been loaded or the memory disk which had once been removed has been returned into the disk drive module 94**.

When it is determined in the decision step P4 that either the file-select/fast-forward control switch 50 or the file-select/fast-reverse control switch 52 of the control unit 14 is turned on, the computer system 80 proceeds to the playback subroutine program **100*a*** as above discussed.

With the switch 50 or 52 thus turned on, a certain piece of music is selected from among the files of the memory disk in the disk drive module 94 in accordance with a file select subroutine R1 in the flowchart of FIG. 5A. The file name (in number) and title of the selected piece of music are now displayed respectively on the file name display window 42 and prompt information display window 44 of the liquid-crystal display section 40. By this file select subroutine R1, furthermore, the data code indicating the file name which may have been memorized in one of the working registers 86 (FIG. 3) is updated to represent the file name of the currently selected piece of music.

By preference of the operator, the key for the part of the music to be reproduced by the player piano 10 per se may then be changed with use of the transposition enable switch 66 and the associated switch 68 or 70 of the control unit 14 to execute a transposition subroutine R2 in the flowchart of FIG. 5A. The data code of the key which may have been memorized in one of the working registers 86 is also updated to represent the currently selected key for the part of the music to be played back by the piano 10. After the desired key for the music to be played back has thus been selected, any one of the playback repeat switches 56, 58 and 60 may be depressed to execute a playback repeat scheduling subroutine R3 in the flowchart of FIG. 5A. All the musical numbers of the program on the memory disk will be played back repeatedly with the first playback repeat switch 56 depressed or a single selected piece of music will be played back repeatedly with the second playback repeat switch 58 depressed. Alternatively, the third playback repeat switch 60 may be used for the repeated playback of a particular limited section of a single selected piece of music. The data code indicating the playback repeat schedule which may have been memorized in any or ones of the working registers 86 is also updated to represent the currently selected schedule.

The sound-volume control switch 62 may then be depressed to execute a sound-volume select subroutine R4 in the flowchart of FIG. 5A if it is desired to adjust the sound volume of the music to be reproduced by the player piano 10. The sound volume which may be produced from the player piano 10 is thus stepwise varied with the decrementing or incrementing switch 68 or 70 kept depressed. The data code indicating the sound volume which may have been memorized in one of the working registers 86 is also updated to represent the sound volume thus selected for the part of the music to be played back by the piano 10. Furthermore, the tempo of the music to be reproduced by each of the player piano 10 and the keyboard console 12 may be adjusted with use of the tempo select switch 64 and one of the decrementing and incrementing switches 68 and 70 to execute a tempo select subroutine R5 in the flowchart of FIG. 5A. The data code indicating the tempo which may have been memorized in one of the working registers 86 is also updated to represent the currently selected tempo for the part of the music to be played back by the piano 10. For the switch or switches not acted upon after the musical number to be played back has been selected, the normal operation parameter established for the switch or each of the switches will be set automatically by a default rule which is in effect with the system initializing program executed by the step P1 of the main routine program 100 (FIG. 4).

The computer system 80 then detects as by decision step P11 whether or not the selected piece of music is registered as an ensemble musical number. When the answer in the step P11 is in the negative, then the computer system 10 proceeds to an ordinary or non-ensemble-mode playback subroutine 100*c* also incorporated in the computer system 80. The ordinary or non-ensemble-mode of playback operation is typically a solomode of playback operation which may be performed by either the player piano 10 per se or the keyboard console 12 alone. If it is determined in the step P11 that the piece of music selected is registered as an ensemble musical number, the computer system 80 then proceeds to another decision step P12 to detect whether or not the stop switch 54 is turned on. If it is found that the stop switch 54 remains turned off, the computer system 80 performs the step P12 repeatedly until it is finally determined that the stop switch 54 is depressed and turned on. It being now found that the stop switch 54 is turned on, the computer system 80 proceeds to process step P13 so as to display on the prompt information display window 44 the registered channel number indicating that part of the selected ensemble musical number which is to be played back by means of the player piano 10 per se. Subsequently, the computer system 80 confirms whether or not the ensemble part select switch 72 or 74 is turned on. If it is desired by the operator to change the part of the ensemble musical number to be played back by means of the piano 10, he may depress or may have depressed one of the ensemble part select switches 72 and 74 to effect such a change. If this is the case, the computer system 80 then proceeds to process step P15 to make an alteration of the part of the ensemble musical number which is to be played back by the player piano 10. The result of the alteration is also displayed on the prompt information display window 44 by the step P15 and the coded musical data relating to the newly selected part of the ensemble mucical piece is loaded into an appropriate one of the working registers 86 (FIG. 3) of the computer system 80.

If it is determined in the decision step P14 that none of the ensemble part select switches 72 and 74 is turned on or upon completion of the procedures by the process step P15, the computer system 80 proceeds to decision step P16 to detect whether or not the record/playback start/pause switch 48 is turned on. If the answer in the step P16 is in the negative, then the computer system 80 recycles either the loop consisting of the steps P14, P15 and P16 or the loop consisting of the steps P14 and P16 until it is finally found that the start/pause switch 48 is depressed and turned on. Now that the start/pause switch 48 is found turned on and the answer in the decision step P16 is turned affirmative, the computer system 80 goes to process step P17 so that the coded musical data for the respective parts of the selected ensemble musical number are read from the corresponding file in the memory disk. The step P17 is followed by process step P18 by means of which the musical data thus read from the memory disk is processed so that the tempo of the music to be played back is in accord with the tempo selected by the tempo select subroutine R5 unless the selected tempo conforms to the normal tempo established by a default rule. The computer sytem 80 then shifts to decision step P19 to detect, for each of the channel numbers respectively assigned to the individual parts of the selected ensemble musical number, whether or not the channel number conforms to that assigned to the particular part of the musical piece to be played back by the player piano 10 per se. If the answer is given in the affirmative in respect of one part of the musical number, the coded musical data representative of the particular part of the musical number is transferred through the MIDI input/output control circuit 90 (FIG. 3) to the input/output interface control module in the player piano 10 and is thereby decoded into driver signals as by step P20. The driver signals produced by the input/output interface control module in the player piano 10 are supplied to the solenoid-operated drive assemblies for the key action and control pedal mechanisms of the piano 10. The solenoid-operated drive assemblies in the piano 10 are thus selectively actuated to drive the key action and control pedal mechanisms of the player piano 10 so that the piano 10 starts to reproduce that part of the ensemble musical number which is allocated to the piano 10 per se. The answer for the other part of the musical piece in question being in the negative, the coded musical data representative of the particular part is transferred by way of the MIDI input/output control circuit 90 of the computer system 80 to the MIDI input terminal of the keyboard console 12 as by step P21. The coded musical data transferred to the keyboard console 12 are decoded so that the keyboard console 12 also starts to reproduce that part of the ensemble musical number which is allocated to the keyboard console 12. Both the player piano 10 and the keyboard console 12 now start ensemble-mode playback operation in concert with each other. It may be herein noted that the transmission of the data to the keyboard console 12 in particular is effected with a certain delay from the transmission of the data to the player piano 10 as will be described in more detail.

The ensemble-mode playback operation being thus started subsequently to the parallel steps P20 and P21 as above described, the computer system 80 starts to sequentially monitor or scan the individual switches and controls 96 on the control unit 14 so as to detect as by step P22 whether or not the record/playback start/pause switch 48 has been depressed and is turned on for a second time. If it is thus determined by step P22 that the start/pause switch 48 is turned on, the central processing unit 82 of the computer system 80 sends out to the disk drive module 94 an instruction to interrupt the readout of the data from the memory disk in place as by step P23. The computer system 80 thereafter proceeds to decision step P24 to further detect whether or not the start/pause switch 48 has been depressed after the playback operation was stopped by the step P23. If the answer in the step P24 is in the affirmative, the computer system 80 jumps back to the previous step P17 to re-start the reading of the data from the memory disk in use to proceed with the playback operation for the currently selected ensemble musical number. If the answer in the step P24 is in the negative, then the computer system 80 returns through the connectors B to the initial file select subroutine R1 shown in the flowchart of FIG. 5A to repeat the subroutines R1 to R4 and steps P11 to P16, as required, until it is finally determined in the step P16 that the start/pause switch 48 is depressed and turned on. Readout of the data for the same ensemble musical number or a newly selected ensemble musical number may then be re-started if and when the start/pause switch 48 is found to be turned on in the decision step P16.

In case the answer in the decision step P22 is given in the negative, the computer system 80 scans the switches and controls 96 on the control unit 14 while allowing the disk drive module 94 to continue the reading of the data from the memory disk in place. In this case, the computer system 80 jumps through the connectors A over to decision step P25 shown in the flowchart of FIG. 5B to determine if one of the file-select/fast-forward and file-select/fast-reverse drive switches 50 and 52 is turned on. If it is found in this decision step P25 that either the switch 50 or the switch 52 is turned on, the memory disk in used in the disk drive module 94 is driven at a fast speed either forwardly or backwardly as by step P26 with the playback mode of operation maintained in progress. The fast-forward or fasat-reverse disk drive operation thus started in terminated with the switch 50 or 52 depressed once again. The computer system 80 may then return to the preceding decision step P25 to further send an instruction or instructions to the disk drive module 94 to repeat the fast-forward or fast-reverse disk drive operation if and as requested by the operator. If and when both of the switches 50 and 52 are found turned off in the decision step P25, then the computer system 80 shifts to another decision step P27 to question whether or not the tempo select switch 64 is turned on. If the tempo select switch 64 is found turned on, the tempo of the music being reproduced by the player piano 10 is changed by step P28 through execution of the tempo select subroutine R5 shown in the flowchart of FIG. 5A. Upon completion of the adjustment of the tempo by the step P28, the computer system 80 returns to the preceding decision step P27 to further adjust the tempo if and as requested by the operator. If and when the tempo select switch 64 is found turned off in the decision step P27, it is then detected by decision step P29 whether or not the transposition enable switch 66 is turned on. If the transposition enable switch 66 is found turned on in this decision step P29, the key for the music being played back by means of the player piano 10 may be changed as by step P30 through execution of the transposition subroutine R2 shown in the flowchart of FIG. 5A. After the desired key has thus been selected by the step P30 for the music being played back by the piano 10, the computer system 80 recycles the loop consisting of the steps P29 and P30 until it is finally determined in the step P29 that the transposition enable switch 66 is turned off.

If and when the transposition enable switch 66 is thus found turned off, the computer system 80 shifts to decision step P31 to determine whether or not any one of the playback repeat switches 56, 58 and 60 is turned on. If this is the case, the playback repeat scheduling subroutine R3 shown in the flowchart of FIG. 5A is executed as by step P32 to select the played back repeat function dictated by the playback repeat switch 56, 58 or 60 which is found turned on. The playback repeat schedule thus selected may be altered by recycling the loop consisting of the steps P31 and P32. When it is found in the step P31 that none of the switches 56, 58 and 60 is turned on, the computer system 80 then shifts to decision step P33 to determine whether or not the sound-volume control switch 62 is turned on. If the sound-volume control switch 62 is found turned on in this decision step P33, the sound volume of the music being played back by the player piano 10 may be varied by step P34 through execution of the volume select subroutine R4 shown in the flowchart of FIG. 5A. Upon completion of the re-adjustment of the sound volume by the step P34, the computer system 80 returns to the preceding decision step P33 to further adjust the sound volume if and as requested by the operator. When the soundvolume control switch 62 is found turned off in the decision step P33, it is then detected by decision step P35 whether or not the stop switch 54 is turned on. If it is found that the stop switch 54 remains turned off, the computer system 80 proceeds to another decision step P36 to determine whether or not the readout of the data from the memory disk in use has been terminated. If the answer in the decision step P36 is in the negative, the computer system 80 jumps through the connectors C back to the step P17 in the flowchart of FIG. 5A to continue the reading of the data from the memory disk so as to proceed with the playback operation. If either the answer in the decision step P34 of the answer in the decision step P36 is given in the affirmative, then the computer system 80 recycles to the main routine program 100 shown in FIG. 4.

As will have been understood from the above description, one of the salient features of an automatic music player system according to the present invention is that the key and sound volume which may have once been selected of the music or the part of the music to be or being played back by the player piano 10 and the playback repeat schedule which has once been selected for a piece or pieces of music can be altered not only prior to the start of playback operation but while the playback operation is currently in progress.

Figure 6:
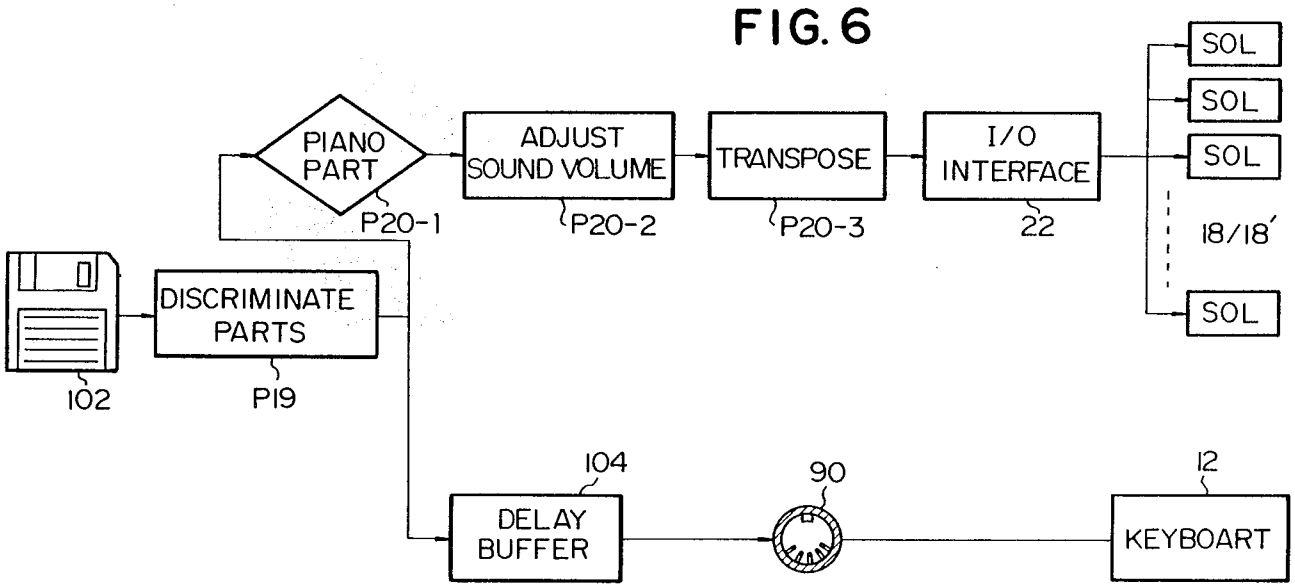
FIG. 6 is a block diagram showing the details of the procedures to be performed in some of the steps included in the flowchart of FIG. 5A to take advantage of the principal features achievable by the present invention.

FIG. 6 shows the details of the procedures to be performed in the steps P19, P20 and P21 in the flowchart of FIG. 5A.

Prior to the actual start of playback operation in an ensemble mode, the coded musical data for the individual parts of the selected ensemble musical number are read from the corresponding file in the memory disk as by the process step P17 in the flowchart of FIG. 5A. The tempo represented by a data code contained in the coded musical data read from the memory disk may be re-adjusted in accordance with the data code stored in one of the working registers 86 which memorizes the tempo selected by the tempo select subroutine R5 in the flowchart of FIG. 5A. Thus, unless the selected tempo memorized by the working register 86 conforms to the normal tempo signatured by the data read from the memory disk, the data read out from the memory disk is modified by the process step P18 so that the tempo of the music to be played back is in accord with the tempo selected by the tempo select subroutine R5.

In the subsequent decision step P19, each of the data codes indicating the channel numbers assigned to the individual parts of the ensemble musical number is compared with the data code stored in one of the working registers 86 which memorizes the data code for the channel number assigned to that part of the music which is to be played back from the player piano 10. The data subblocks which represent the two (or more) parts, respectively, of the selected ensemble musical number are thus discriminated one from the other by the part discriminating means implemented by the decision step P19. From the two subblocks of the data codes of the currently selected ensemble musical number is thus extracted or separated the subblock including the data code which conforms to that representative of the particular part of the music to be played back by the player piano 10 per se. This extraction or separation procedure is represented by step P20-1 in the flowchart shown in FIG. 6, wherein the memory disk assumed to be set in the disk drive module 94 is shown at 102. The coded musical data containing the data code thus extracted by the step P19-1 is then modified in subsequent steps P20-2 and P20-3 so that the data codes respectively representative of the key and sound volume are in afford with those which are represented by the working registers 86 which memorize the key and sound volume selected by the subroutines R2 and R4, respectively, in the flowchart of FIG. 5A. The coded musical data thus processed in the successive steps P20-1, P20-2 and P20-3 is transferred through the bidirectional bus 24 as by the step P20 shown in FIG. 5A to the input/output interface control module 22 provided in the player piano 10. Thus, the step P20 in the flowchart shown in FIG. 5A implements bidirectional first data transmission means providing data communication between the piano 10 or first sound generator means 10 and the control means implemented by the control unit 14 in an automatic music player system according to the present invention. The coded musical data transferred to the player piano 10 in this manner is decoded into driver signals by means of the input/output interface control module 22, whereupon the resultant driver signals are supplied to the individual solenoid-operated drive assemblies 18 and 18' which are provided in association with the key action and control pedal mechanisms (not shown) of the player piano 10. The solenoid-operated drive assemblies 18 and 18' are selectively actuated by these driver signals and drive the key action and control pedal mechanisms of the player piano 10, enabling the piano 10 to start playback of that part of the ensemble musical number which is allocated to the piano 10 per se.

On the other hand, the coded musical data containing the data code representative of the other part of the ensemble musical number is transferred to the keyboard console 12 through the MIDI input/output control circuit 90 of the systme 80 shown in FIG. 3 by the step P21 of the flowchart of FIG. 5A. From the MIDI input-/output control circuit 90 of the system 80, the coded musical data is passed to the MIDI input terminal of the keyboard console 12 via the bidirectional bus 26 shown in FIG. 1. Thus, the step P21 in the flowchart of FIG. 5A implements bidirectional second data transmission means allowing data communication between the keyboard console 12 or second sound generator means and the control means implemented by the control unit 14 in an automatic music player system according to the present invention. The firs and second data transmission means thus provided in an automatic music player system according to the present invention are subsequent to musical part of data subblock discriminating means for discriminating one of the two or more data subblocks from another of the subblocks which represent the individual parts, respectively, of the piece of music to be played back by the player piano 10 or first sound generator means and the keyboard console 12 or second sound generator means of an automatic music player system according to the present invention.

In the automatic music player system embodying the present invention, the coded musical data to be transmitted to the MIDI input terminal of the keyboard console 12 via the second data transmission means is passed to the MIDI input/output control circuit 90 through a delay buffer register 104 and is transferred to the input terminal of the keyboard console 12 therethrough with a predetermined delay time which is typically of the order of 500 msec. Thus, the delay buffer register 104 forms part of delay means for continuously delaying the transmission of data through the second data transmission means from the transmission of data through the first data transmission means throughout the length of the piece of music to be played back by the player piano 10 or first sound generator means and the keyboard console 12 or second sound generator means of an automatic music player system according to the present invention.

The delayed transmission of the data signals to the keyboard console 12 enables the keyboard console to electronically produce sounds in concert with the player piano 10 which produces sounds in a mechanical fashion. The delay time of the order of 500 msec is appropriate for enabling the key action and control pedal mechanisms of the player piano 10 to mechanically produce sounds substantially in concert with the keyboard console 12 which electrically produces sounds in response to the data signal supplied through the delay buffer register 104. The delay buffer memory 104 to effect such delayed transmission of data signals to the keyboard console 12 is implemented advantageously by a delaying subroutine program incorporated into the read-only memory 84 forming part of the computer system 80 shown in FIG. 3. To enable the player piano 10 to perform playback operation in better concert with the keyboard console 12, the durations of the driver signals to be produced by the input/output interface control module 22 of the piano 10 may be controlled in relation to the delay time set on the delay buffer register 104.

Figure 7:
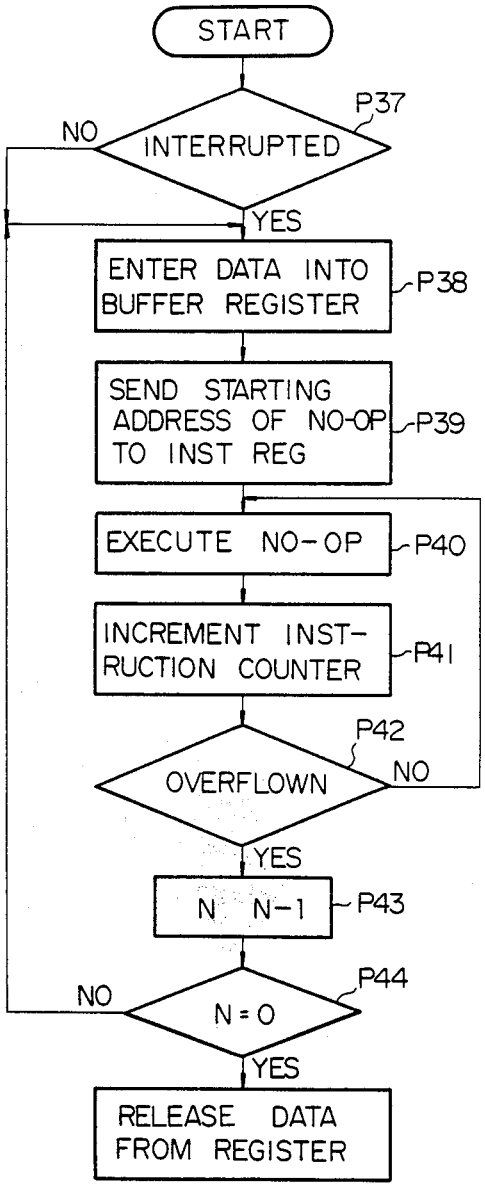
FIG. 7 is a flowchart showing the delaying subroutine program which governs the operation of the delay buffer circuit which feature the control functions of the control unit in the embodiment of an automatic music player system according to the present invention.

FIG. 7 shows a flowchart of the delaying subroutine program governing the delayed transmission of the data signals to the keyboard console 12. Such a delaying subroutine may follow the step P17 or step P18 of the subroutine program depicted in FIG. 5A and is incorporated in the read-only memory 84 of the computer system 80 shown in FIG. 3. The central processing unit 82 of the computer system 80 has capabilities of executing "no-op", viz., no-operation instructions. The machine cycle required for the central processing unit 82 to execute each of such instructions is known so that a predetermined number of no-op instructions corresponds to a given period of time. Thus, no-op instructions of a number appropriate for providing the delay time of, for example, 500 msec to be set on the delay buffer register 104 are stored in that section of the read-only memory 84 which contains the maximum count available of the instruction counter. In the central processing unit 82 of the system 80 is provided an overflow register (not shown) in which is set a predetermined number (N) of times of overflow occurring in the instruction counter.

Now, the delaying subroutine starts with initial arrival of coded musical data at the delay buffer register 104 from the MIDI input/output control circuit 90 of the system 80 shown in FIG. 3. This produces an interrupt into the central processing unit 82, which thus determines that there is an interrupt as by decision step P37 and allows the data to enter the buffer register 104 as by step P38. The central processing unit 82 then proceeds to process step P39 to send the starting address of the no-op instructions in the memory 82 to the instruction counter. The first no-op instruction is thus fetched from the memory 84 and is executed by the central processing unit 82 as by step P40 and, upon completion of the execution of the no-op instruction, the count of the instruction counter is incremented by one as by step P41. The central processing unit 82 then detects whether or not there currently is an overflow occurring in the instruction counter as by decision step P42. It being assumed that there being no overflow in the instruction counter at this stage, the answer in the decision step P42 is given in the negative so that the central processing unit 82 returns to the step P40 to execute the second no-op instruction, with the result that the count of the instruction counter is further incremented by one as by the subsequent step P41. The count of the instruction counter is in this fashion incremented one by one by reiteration of the loop consisting of the steps P40, P41 and P42 until it is finally determined in the decision step P42 that there is an overflow occurring in the instruction counter. The answer in the decision step P42 being now turned affirmative, the count (N) of the overflow register is decremented by one as by step P43. The central processing unit 82 then questions whether or not the count thus decremented of the overflow register is zero as by decision step P44. If it is found in this step P44 that the current count of the overflow register is still not zero, then the central processing unit 82 recycles to the step P39 and sends the starting address of the no-op instructions to the instruction counter for a second time. The loop consisting of the steps P39, P40, P41, P42, P43 and P44 is thus reiterated repeatedly until it is finally determined in the step P44 that the count of the overflow register has reached zero, meaning that the no-op instructions have been executed a predetermined number of times which corresponds to the desired delay time for the buffer register 104. Now that there is no overflow occurring in the instruction counter, the coded musical data to be played back by the keyboard console 12 is released from the register 104 and is passed to the keyboard console 12. The coded musical data read from the memory disk 102 is thereafter passed successively through the delay buffer register 104 to the keyboard console 12 constantly with a delay of, for example, 500 msec from the transmission of data to the player piano 10.

What is claimed is:

1. An automatic music player system having an ensemble playback mode of operation using a memory medium having recorded thereon a piece of music composed of at least two combined parts to be reproduced separately of each other, the parts being recorded in the form of at least two data subblocks, comprising (a) first sound generator means to mechanically generate sounds when mechanically or electrically actuated, (b) at least one second sound generator means to electronically generate sounds when electronically actuated and (c) control means operatively connected to the first and second sound generator means, wherein said control means is operative so that (1) one of the two or more data subblocks of the data read from the memory medium is discriminated from another, whereupon the discriminated one of the data subblocks is transmitted to the first sound generator means and another data subblock is transmitted to the second sound generator means, and (2) the transmission of data to the second sound generator means is continuously delayed by a predetermined period of time from the transmission of data to the first sound generator so that the first and second sound generator means are enabled to produce sounds concurrently and in concert with each other.

2. An automatic music player system having a plurality of modes of operation including an ensemble playback mode of operation using a data storage medium having recorded thereon performance data representative of a piece of music composed of at least two combined parts to be reproduced separately of each other, the data being recorded on said memory medium in the form of at least two data subblocks consisting of a subblock of data representative of one of said parts and a subblock of data representative of the other of said parts, comprising (a) first sound generator means operative to mechanically generate sounds when actuated;

(b) at least one second sound generator means operative to electronically generate sounds when actuated; and (c) control means operatively connected to said first sound generator means and said second sound generator means, the control means comprising (c-1) data reading means operative to read data from said data storage medium, (c-2) discriminating means for discriminating one of said at least two data subblocks from another, (c-3) bidirectional first data transmission means providing data communication between said first sound generator means and said control means for transmitting the discriminated one of the data subblocks to said first sound generator means, said first sound generator means being to be actuated in response to the data transmitted through said first data transmission means, and (c-4) at least one bidirectional second data transmission means providing data communication between said second sound generator means and said control means for transmitting another data subblock to said second sound generator means, said second sound generator means being to be actuated in response to the data transmitted through said second data transmission means.

3. An automatic music player system having a plurality of modes of operation including an ensemble playback mode of operation using a data storage medium having recorded thereon performance data representative of a piece of music composed of at least two combined parts to be reproduced separately of each other, the data being recorded on said memory medium in the form of at least two data subblocks consisting of a subblock of data representative of one of said parts and a subblock of data representative of the other of said parts, comprising (a) first sound generator means operative to mechanically generate sounds when actuated;

(b) at least one second sound generator means operative to electronically generate sounds when actuated; and (c) control means operatively connected to said first sound generator means and said second sound generator means, the control means comprising (c-1) data reading means operative to read data from said data storage medium, (c-2) discriminating means for discriminating one of said at least two data subblocks from another, (c-3) bidirectional first data transmission means providing data communication between said first sound generator means and said control means for transmitting the discriminated one of the data subblocks to said first sound generator means, said first sound generator means being to be actuated in response to the data transmitted through said first data transmission means, (c-4) at least one bidirectional second data transmission means providing data communication between said second sound generator means and said control means for transmitting another data subblock to said second sound generator means, said second sound generator means being to be actuated in response to the data transmitted through said second data transmission means, and (c-5) delay means for delaying the transmission of data through said second data transmission means by a predetermined period of time from the transmission of data through said first data transmission means.

4. An automatic music player system as set forth in claim 3, in which said delay means is conditioned to continuously delay the transmission of data through said second data transmission means by a period of time of the order of 500 milliseconds from the transmission of data through said first data transmission means.

5. An automatic music player system as set forth in claim 4, in which said first sound generator means forms part of a piano and comprises (a-1) a keyboard, (a-2) a key action mechanism operatively connected to the keyboard, (a-3) a control pedal mechanism, (a-4) string arrangement associated with the key action and control pedal mechanisms, (a-5) electromagnetically operated drive assemblies associated with said key action mechanism and said control pedal mechanism, respectively, and (a-6) interface control means operatively intervening between said control means and said electromagnetically operated drive assemblies through said first data transmission means, said interface control means being operative to electrically actuate said drive assemblies in response to signals representative of the data received from said control means through said first data transmission means during playback mode of operation.

6. An automatic music player system as set forth in claim 5, in which said plurality of modes of operation of the player system further include a recording mode of operation and in which said first sound generator means further comprises sensor assemblies respectively associated with said key action mechanism and said control pedal mechanism, said sensor assemblies being operative to produce musical data signals representative of the musical information keyed in on said keyboard during recording mode of operation of the player system.

7. An automatic music player system as set forth in claim 2 or 3, in which said control means further comprises designating means cooperative with said discriminating means for selectively designating the data subblock to be transmitted to said first sound generator means.

* * * * *